United States Patent [19]

Molignoni

[11] Patent Number: 4,611,655

[45] Date of Patent: Sep. 16, 1986

[54] HEAT EXCHANGER

[75] Inventor: Albert J. Molignoni, Butte, Mont.

[73] Assignee: Power Shaft Engine, Limited Partnership, Butte, Mont.

[21] Appl. No.: 788,827

[22] Filed: Oct. 18, 1985

Related U.S. Application Data

[60] Continuation-in-part of Ser. No. 695,284, Jan. 28, 1985, abandoned, which is a division of Ser. No. 554,603, Nov. 23, 1983, Pat. No. 4,561,256, which is a continuation-in-part of Ser. No. 455,745, Jan. 5, 1983, abandoned.

[51] Int. Cl.[4] ..... F28D 21/00

[52] U.S. Cl. ..... 165/163; 165/159; 122/183

[58] Field of Search ..... 165/159, 160, 163, 164; 122/160, 161, 162, 183, 367 C

[56] References Cited

U.S. PATENT DOCUMENTS

| | | | |
|---|---|---|---|
| 3,006,612 | 10/1961 | Herbert | 165/159 |
| 4,306,618 | 12/1981 | Honkajarvi | 165/163 |
| 4,546,826 | 10/1985 | Zitzmann | 165/163 |

*Primary Examiner*—Stephen F. Husar

*Attorney, Agent, or Firm*—Marshall, O'Toole, Gerstein, Murray & Bicknell

[57] ABSTRACT

This disclosure relates to a heat exchanger including a plurality of cylindrical walls that are joined together to form at least one annular chamber. A plurality of tubes spiral through the chamber, each of the tubes forming a coil and the coils being axially separated. A fluid is moved in one direction through the coiled tubes, and simultaneously another fluid is moved through the chamber, thereby producing a transfer of heat between the two fluids. In the instance where the heat exchanger is used as a boiler or steam generator, the fluid in the tubes is water or water vapor, and the fluid in the chamber is hot exhaust gases from a burner mounted at the center of the exchanger.

10 Claims, 18 Drawing Figures

FUEL
BOILER
AIR
CONDENSER
AIR
AIR
P

RESERVOIR
166
171
153
172
173
174
154
162
131
134
141
132
133
137
138
136
146
147
158
151
157
159
156
161
148
144
142
143
176
139
168
164
167
163
190
187
188
182
184
186
183
189
181
202
200
201
134
136
131
198
203
182
197
193
192
196
194

HEAT EXCHANGER

RELATED APPLICATIONS

This application is a continuation-in-part of application Ser. No. 695,284 of Albert J. Molignoni, filed on Jan. 28, 1985 and titled External Combustion Engine, now abandoned, which was a divisional application based on Ser. No. 554,603 filed on Nov. 23, 1983, now U.S. Pat. No. 4,561,256, which was a continuation-in-part of Ser. No. 455,745 filed on Jan. 5, 1983, now abandoned.

FIELD AND BACKGROUND OF THE INVENTION

This invention relates to a heat exchanger for use, for example, with an external combustion engine that utilizes a heated vapor, such as steam, under pressure.

There are many types or designs of engines commonly available that are useful for driving various machines. Well known engines of this character include gasoline, diesel and steam engines. Such engines have, of course, in most instances worked well, but there is nevertheless a continuing need for an efficient, low cost (both in manufacture and operation) engine capable of burning a variety of fuels.

It is therefore a general object of the present invention to provide an improved heat exchanger especially suited for use with an engine of the foregoing character.

An engine system including the foregoing engine further comprises an improved vapor generator wherein fuel is burned in order to provide the vapor under high pressure. An improved vapor condenser receives the vapor that is exhausted by the engine.

SUMMARY OF THE INVENTION

A heat exchanger in accordance with the present invention including a plurality of cylindrical walls that are joined together to form at least one annular chamber. A plurality of tubes spiral through the chamber, each of the tubes forming a coil and the coils being axially separated. A fluid is moved in one direction through the coiled tubes, and simultaneously another fluid is moved through the chamber, thereby producing a transfer of heat between the two fluids. In the instance where the heat exchanger is used as a boiler or steam generator, the fluid in the tubes is water or water vapor, and the fluid in the chamber is hot exhaust gases from a burner mounted at the center of the exchanger.

While the following detailed description refers to steam and water, it should be understood that other substances having vapor and liquid states may be utilized instead.

BRIEF DESCRIPTION OF THE DRAWINGS

The invention as well as additional objects and advantages will become apparent from the following detailed description taken in conjunction with the accompanying figures of the drawings, wherein.

DETAILED DESCRIPTION OF THE DRAWINGS

Figures 1, 2, 3, 4:
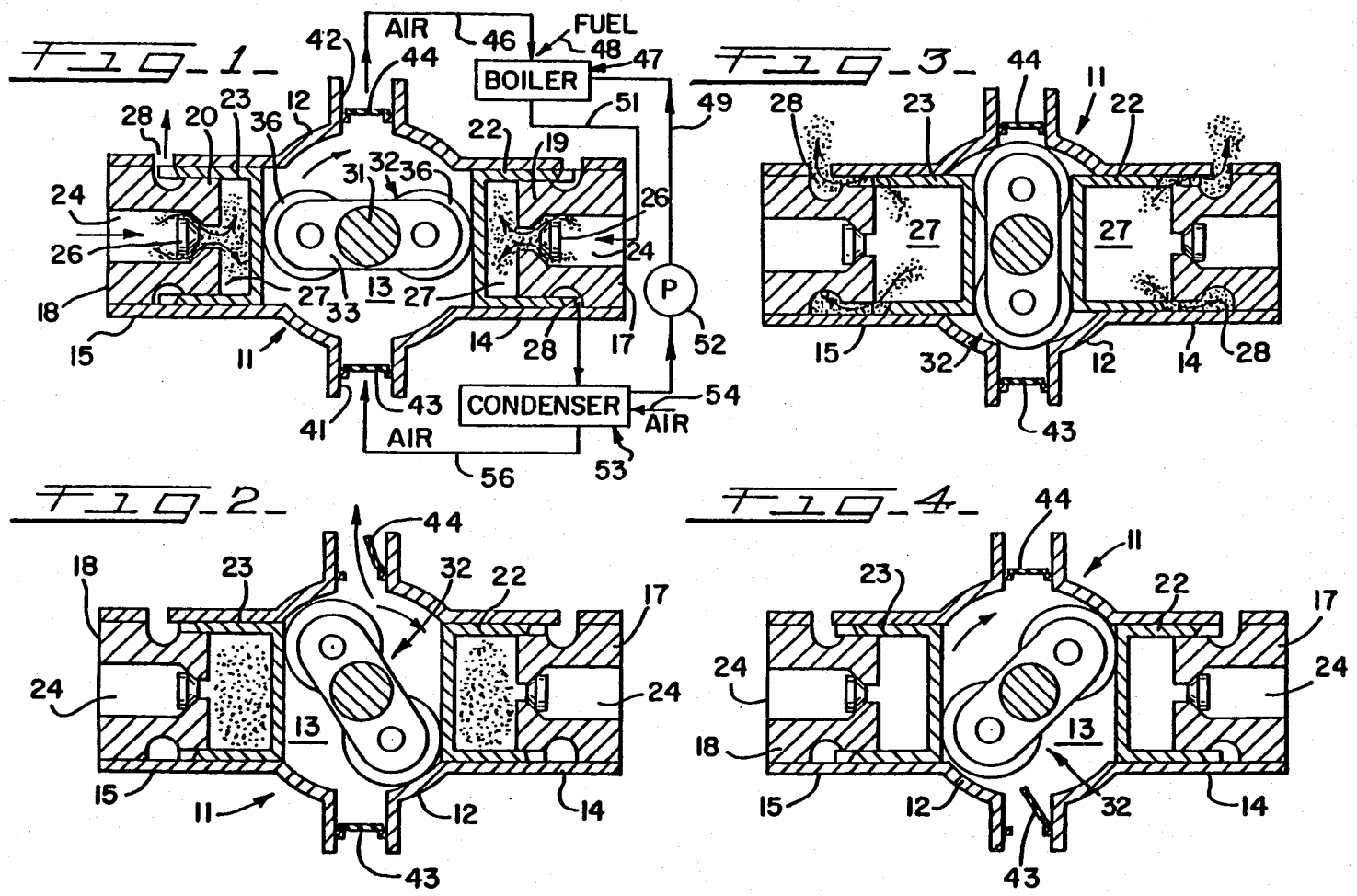
FIG. 1 is a schematic diagram of an engine system in accordance with the present invention.
FIGS. 2, 3 and 4 are schematic diagrams generally similar to FIG. 1, but showing other stages in the operation of the engine.

With reference first to FIGS. 1 through 4, the engine comprises an engine housing 11 having an enlarged central portion 12 that forms a power shaft chamber 13, and two oppositely extending cylinder portions 14 and 15. The two cylinder portions have cylinder heads 17 and 18 secured within them, the inner ends 19 and 20 having reduced diameter sections so that pistons 22 and 23 may be received between the portions 19 and 20 and the inner surfaces of the cylinder portions 14 and 15 of the housing. A steam intake passage or port 24 is formed in each cylinder head 17 and 18, and steam injection valves 26 are formed on the two cylinder heads 17 and 18. When the valves 26 are open, steam under high pressure flows through the ports 24 and into an expansion chamber 27 formed within each piston and the inner ends of the cylinder heads 17 and 18. In addition to the steam intake ports 24, exhaust ports 28 are formed in the housing 11. As shown in FIG. 3 and as will be described hereinafter, when the two pistons are moved radially inwardly, or toward each other, the expansion chambers 27 are placed in communication with the exhaust ports 28, thereby allowing the steam to be exhausted from the two expansion chambers.

Figure 7:
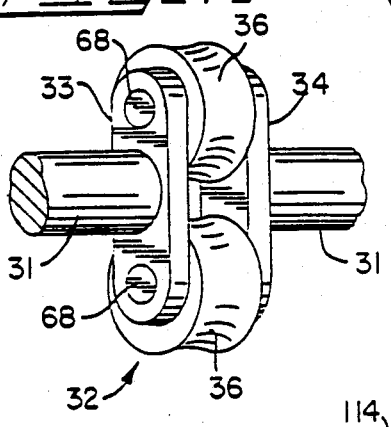
FIG. 7 is a perspective view of a roller assembly of the engine.

As previously mentioned, the engine housing further includes an enlarged central portion 12 which forms the enclosure 13, and a power shaft 31 is rotatably mounted and extends through the chamber 13. A roller assembly, better shown in FIG. 7, is secured to the power shaft 31, the roller assembly being given the numeral 32, and the roller assembly 32 connects the reciprocating pistons 22 and 23 with the power output shaft 31. The roller assembly 32 includes two spaced links 33 and 34 which are rigidly scured to the power output shaft 31, and rollers 36 are rotatably mounted on the ends of the two links 33 and 34. As the shaft 31 rotates and the pistons reciprocate in and out within the cylinders, the rollers 36 roll across the crowns of the two pistons and preferably are in constant contact with the pistons.

The housing of the engine further has formed therein an air intake port 41 and an air outlet port 42, and one way or check valves 43 and 44 are mounted in the ports 41 and 42 respectively. The valve 43 allows flow of air into the chamber 13 whereas the valve 44 allows air to flow out of the chamber. Air flowing out of the chamber through the outlet port 44 is carried by an air line 46 to a boiler or steam generator 47 to be described in greater detail hereinafter in connection with FIGS. 8 and 9. Fuel is also fed into the boiler 47 by a fuel line 48. A water intake line 49 carries water to the boiler 47 and a steam outlet line 51 carries the hot steam from the boiler 47 to the engine. The water in the line 49 is received from a pump 52 that is connected to the water outlet of a condenser 53. The condenser 53 also receives the steam being exhausted through the exhaust ports 28 of the engine, and the condenser 53, of course, serves to cool the steam. The heat from the steam is transferred to air which enters the condenser 53 through an air intake line 54, and an air outlet line 56 conducts the air from the condenser 53 to the air intake port 43 of the engine.

While FIG. 1 shows steam lines leading from the boiler and the condenser only to the cylinder head 17, it should be understood that similar lines connect the boiler 47 and the condenser 53 to the cylinder head 18.

The operation of the engine system may now be understood from the various positions of the engine shown in FIGS. 1 through 4. In FIG. 1, the two pistons 22 and 23 are in their bottom dead center (BDC) positions where they are radially displaced to their maximum extent away from each other. It should be noted from FIG. 1 that the two pistons 22 and 23 are mounted and reciprocate on the same axis or centerline, and that this axis of reciprocation extends through and is perpendicular to the axis of rotation of the power output shaft 31. The axes of rotation of the two rollers 36 are parallel to the axis of the shaft 31. In the position shown in FIG. 1, the two valves 26 are open and steam under high pressure is admitted into the expansion chambers 27, the steam being received from the steam outlet line 51 of the boiler 47. The steam pressure forces the two pistons 22 and 23 radially inwardly, or toward each other, thereby exerting a radially inward force on the two rollers 36. Assuming that the roller assembly 32 and the power output shaft 31 are rotating in the clockwise direction as seen in FIGS. 1 through 4, the radially inward movement caused by the expanding steam within the expansion chambers 27 will exert a turning force on the roller assembly and the shaft 31, the amount of this torque, of course, being related to the pressure of the steam in the chamber 27. The rotation of the shaft 31 may be started by a starting motor (not shown). This turning force continues (see FIG. 2) as the two pistons 22 and 23 move in their expansion strokes, and as the two pistons approach their top dead center (TDC) positions, as shown in FIG. 3, the steam exhaust ports 28 are opened by the movements of the two pistons 22 and 23. It will be apparent from a comparison of FIGS. 2 and 3 that the roller which was in contact with the piston 23 will then move into contact with the piston 22 and vice versa for the other roller 36. Continued turning movement of the power output shaft 31, the roller assembly 32 and the mechanism (not shown) being driven by the power output shaft 31 will now force the two pistons 22 and 23 radially outwardly. This continued movement, of course, occurs due to the momentum of the rotating parts. As the two pistons 22 and 23 move radially outwardly, they reduce the volumes of the two expansion chambers 27 thereby causing a portion of the steam within the chambers 27 to be exhausted or forced out of the chambers through the exhaust ports 28. As shown in FIG. 4, when the two pistons 22 and 23 move most of the distance in their travel twoward the BDC positions, the pistons again close the exhaust ports and any remaining steam within the expansion chambers is compressed. This compression continues as the shaft 31 and the roller assembly continue their clockwise rotative movement, and when the two pistons are almost in their BDC positions the valves 26 again open and admit additional steam under high pressure. The system is then back at the position shown in FIG. 1 and the foregoing series of events is repeated. It should be noted that there are two expansion strokes of the pistons and therefore two power applying strokes during each complete revolution of the shaft 31, or cycle of the engine.

As the pistons 22 and 23 move from the BDC position, shown in FIG. 1, to the TDC position, shown in FIG. 3, the volume of the chamber 13 is reduced, and the chamber volume is increased as the two pistons move from the TDC positions to the BDC positions. This change in volume is utilized to pump air from the condenser 53 to the boiler 47 as previously mentioned. When the chamber 13 volume is decreasing during the expansion strokes of the pistons, air is forced out of the valve 44 to the boiler 47, and as the volume decreases during movement from the TDC position to the BDC position, additional air is drawn into the chamber 13 from the condenser 53. Thus, the efficiency of the engine system is increased by moving the air through the condenser 53 and thereby preheating it prior to feeding the air into the boiler 47 for combustion purposes, and the movement of the reciprocating pistons of the engine is utilized to move the air. The pump 52, of course, circulates the steam and liquid through the boiler 47, the condenser 53 and the engine during the engine operation.

Figure 5:
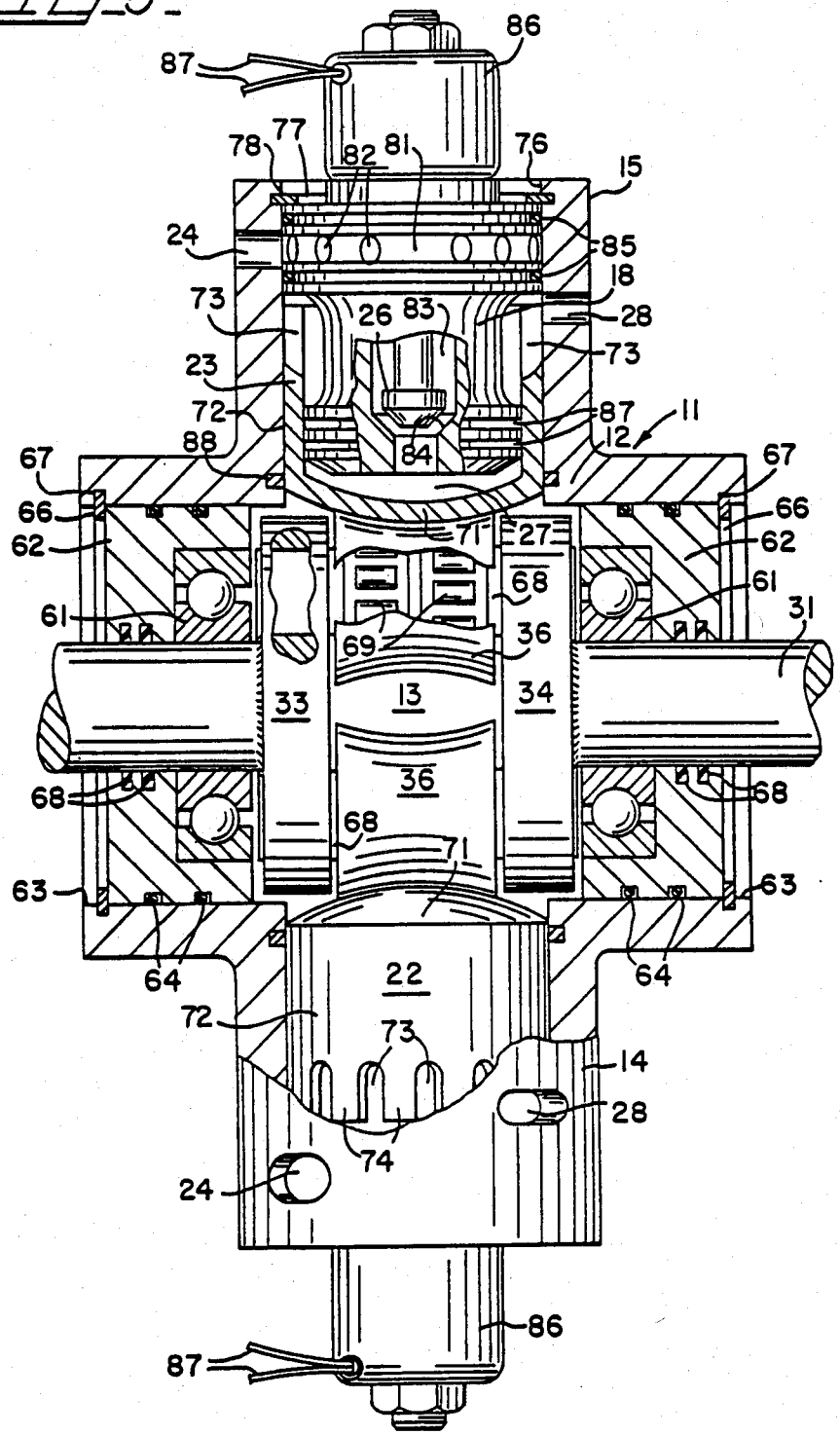
FIG. 5 is an enlarged view partially in section of the engine of the system shown in FIGS. 1 through 4.

With reference to FIG. 5, the power output shaft 31 is rotatably supported by ball bearings 61 which, in turn, are supported by end bells 62 on the engine housing 11. Cylindrical openings 63 are formed in the central portion 12 of the housing 11 and the cylindrical end bells 62 are snugly received within the openings 63. O-rings 64 are provided between the engaging surfaces of the housing 11 and the end bells in order to seal the connections. To prevent the end bells 62 from inadvertently moving out of the openings 63, circular snap rings 66 are mounted in grooves 67 formed in the inner surfaces of the openings 63, the snap rings 66 engaging the outer surfaces of the two end bells 62. Thus, the end bells 62 may readily be removed merely by removing the snap rings 66 and then sliding the end bells out of the housing. Seals 68 are also provided between the shaft 31 and the inner surface of the end bells 62 in order to seal the connections between the shaft and the end bells.

The two rollers 36 of the roller assembly 32 are mounted on the links 33 and 34 by pins 68 that extend parallel to the power output shaft 31 and are secured to the outer end portions of the two links 33 and 34. Roller bearings 69 are provided to mount the rollers 36 for free rotation on the pins 68.

It will be noted from FIG. 5 that the domes or crowns 71 of the two pistons 22 and 23 have convex contours and that the outer surfaces of the two rollers 36 have mating concave surfaces. The rollers 36 are therefore able to roll across the domes or crowns of the two pistons and the curvatures of the engaging surfaces increase the surface contact area. Each piston 22 and 23 includes a straight cylindrical skirt part 72 and the previously mentioned convex dome or crown 71. At the outer end of the skirt 72 of each piston is formed a plurality of axially extending slots 73 which form fingers 74 therebetween. When the pistons are moved to the TDC positions shown in FIG. 3, the slots 73 extend inwardly from the cylinder heads 17 and 18 as previously described, thereby enabling steam within the expansion chambers 27 to flow out through the slots 73 and through the steam exhaust ports 28.

The cylindrical portions 14 and 15 of the engine housing 11 also have cylindrical openings 76 formed therein, the exhaust ports 28 and the steam intake ports 24 being formed in the wall. The cylinder heads 17 and 18 are mounted within the cylindrical openings 76 and are retained therein by retainer snap rings 77 that fit in grooves 78 formed in the inner surfaces of the cylindrical portions 14 and 15. As shown in FIG. 5, the retainer snap rings 77 engage the outer surfaces of the heads 17 and 18 and normally prevent them from moving out of the opening. The head 18 may, however, be disassembled simply by first removing the retainer snap rings 77.

Each of the cylinder heads 17 and 18 has an annular groove 81 formed therein adjacent its radially outer edge, and a plurality of radially extending passages 82 connect the groove 81 with a central passage 83 formed through the piston. The steam intake port 24, of course, communicates with the groove 81 so that during operation of the engine there is always steam under pressure in the groove 81, the passages 82 and the central passage 83. At the inner end of the passage 83, a valve seat 84 is formed which mates with the valve stem 26 of, in the present specific example, a solenoid operated steam valve. The solenoids are indicated by the reference numeral 86 and are mounted on the radially outer ends of the cylinder heads. Conductors 87 extend from the solenoid coils (not shown) of the solenoids 86 to a control circuit to be discussed hereinafter. When each solenoid 86 is energized by passing current through it, it moves the valve stem or plunger 26 radially outwardly and thereby away from the valve seat 84 in order to allow steam to flow from the central passage 83 to the expansion chamber 27. The construction for the other cylinder head 17 is, of course, the same. O-rings 85 are provided beween the cylinder head and the engine housing 11 on opposite sides of the groove 81 in order to seal the groove. In addition, piston rings 87 are provided on each cylinder head and in engagement with the inner periphery of the associated piston in order to seal the expansion chamber 27 when the piston is moved radially outwardly. A piston ring 88 is also provided in the engine housing 11 and in engagement with the outer surface of each piston, the piston rings 87 and 88 thereby supporting and guiding the reciprocating movement of the piston. The pistons are, however, able to rotate on their axis during operation of the engine, and this is advantageous because it continuously presents new bearing or wear surfaces to the rollers 36.

Figure 10:
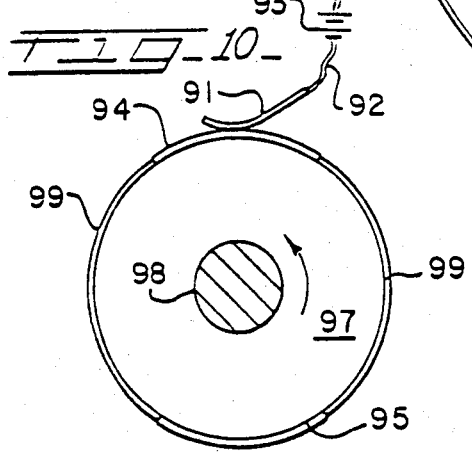
FIG. 10 is a schematic diagram of part of a control circuit of the system.

The solenoid coil is connected by the wires or conductors 87 to an electric control circuit that also includes a wiper 91, shown in FIG. 10. The wiper 91 is connected by a conductor 92 to a voltage source such as a battery 93 and from the battery to the solenoid coils. A pair of arcuate contacts 94 and 95 are mounted on the outer periphery of a wheel 97 that is fastened to a rotating shaft 98 which is coupled to rotate in synchronism with the power output shaft. Between the two arcuate contacts 94 and 95 are insulators 99. Thus, as the shaft 98 and the wheel 97 are rotating, the wiper 91 engages the two contacts 94 and 95. The circuit is completed through the battery 93 and the solenoid coil each time the wiper 91 engages one of the contacts 94 and 95, and this may be accomplished, for example, by grounding the contacts 94 and 95 on one side of the solenoid coil, the other side of the solenoid coil being connected to the battery 93.

Figure 6:
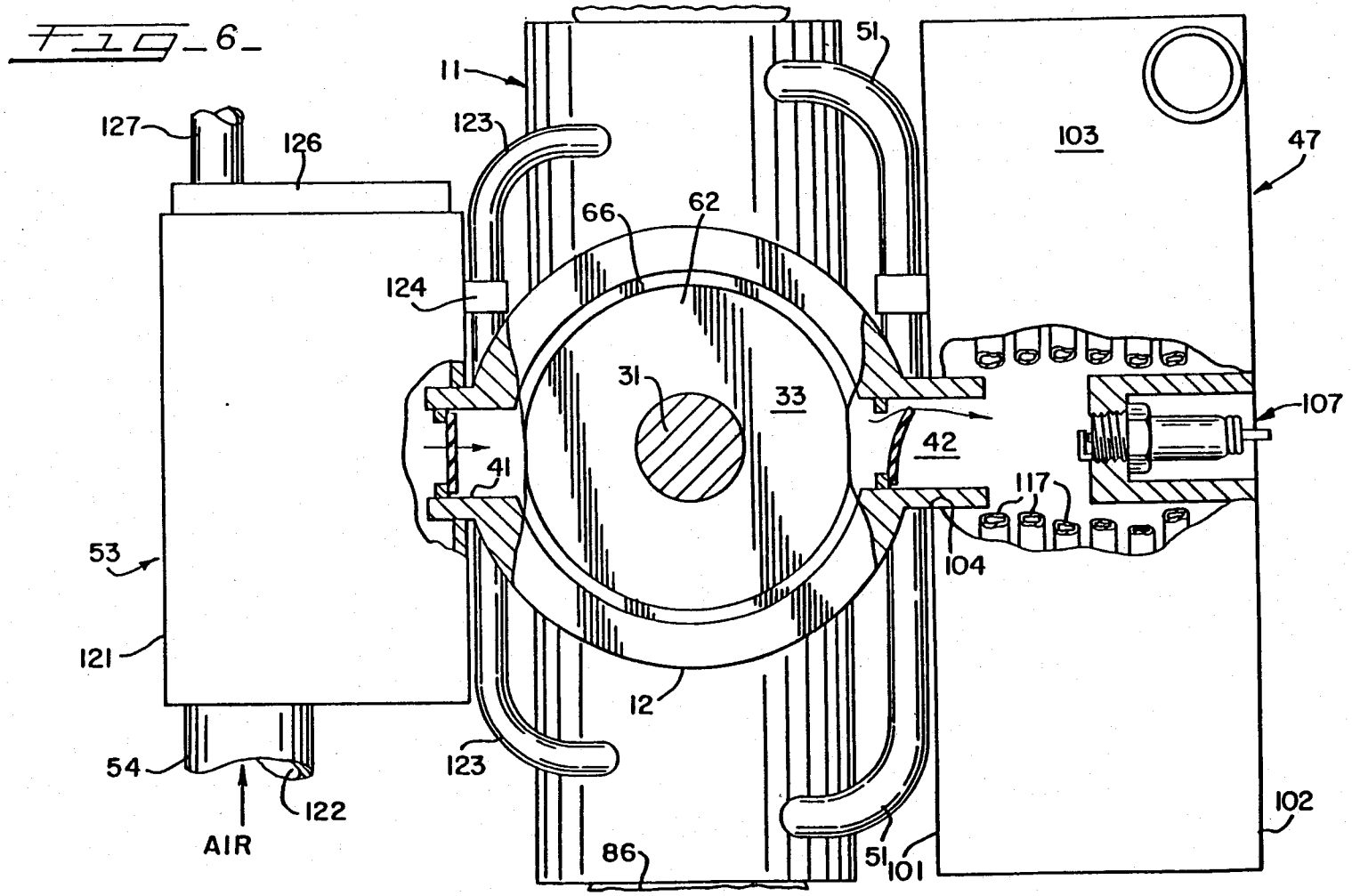
FIG. 6 is another view of the engine shown in FIG. 5.
Figure 8:
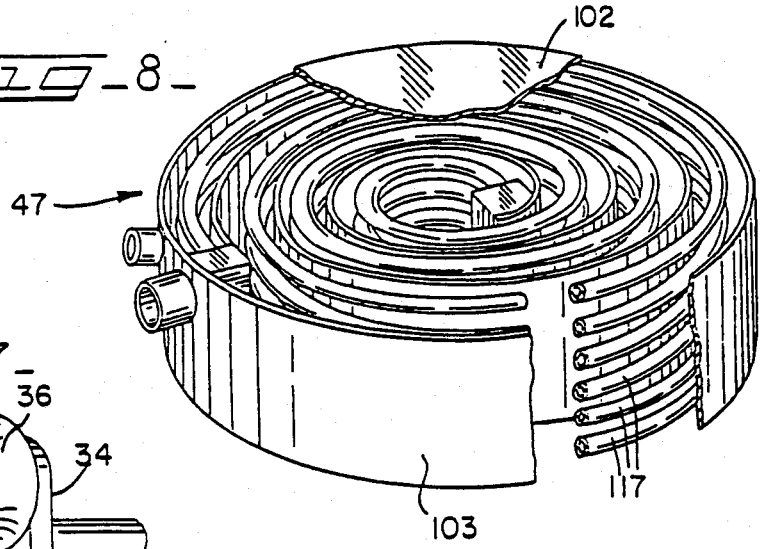
FIG. 8 is a perspective view partially in section of a vapor generator of the system.
Figure 9:
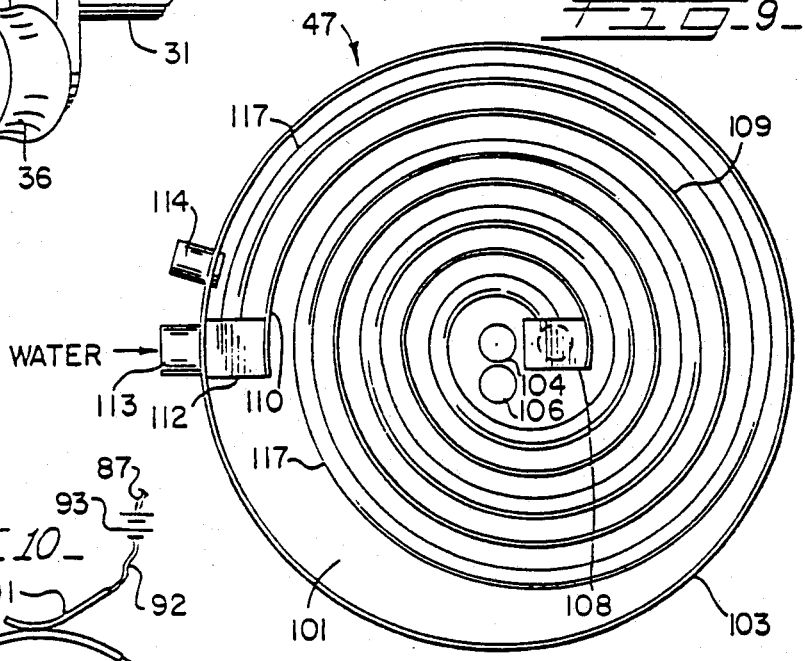
FIG. 9 is a plan view with some parts broken away to show underlying parts of the generator shown in FIG. 8.

The steam boiler is better illustratged in FIGS. 6, 8 and 9. The boiler includes a drum-like housing including flat bottom and top walls 101 and 102 and a cylindrical side wall 103. An opening 104 is formed in the bottom wall 101 that receives the fresh air from the outlet 42 of the engine housing 11, and adjacent the air intake opening 104 is a fuel intake opening 106 (FIG. 9). In addition, the igniter, such as a spark plug 107 (FIG. 6), is mounted at approximately the center of the boiler by, for example, mounting it on the top wall 102, as shown in FIG. 6. Thus, the center area of the housing forms a combustion chamber when air and fuel are admitted through the openings 104 and 106 and the igniter 107 is operated.

Also mounted at approximately the center of the boiler housing is a steam outlet manifold 108 that extends between the bottom and top walls 101 and 102 and is secured thereto. Spiralling outwardly from the manifold 108 is a wall 109 that has its inner end connected to the steam outlet manifold 108 and its outer end 110 connected to a water inlet manifold 112. Suitable couplings 113 are connected to the manifolds 108 and 112 for connecting the steam and water to the adjoining parts of the system. An exhaust outlet tube 114 is connected in the cylindrical outer wall 103 of the boiler and is in communication with the interior boiler area adjacent the manifold 112. Also spiralling radially outwardly from the steam manifold 108 to the water intake manifold 112 are a plurality of tubes 117 which are connected to both the manifolds 108 and 112. Thus, during operation of the boiler, water flows into the coupling 113 and the manifold 112, and into the outer ends of the tubes 117. The water then flows in a spiral path in the direction of the center of the boiler until it reaches the outlet manifold 108 and then is led out of the boiler. At the same time, the heat and exhaust generated in the combustion chamber adjacent the fuel and air openings 104 and 106 flows in a spiral path from the center of the boiler in a radially outward direction to the exhaust outlet 114. The center part or combustion chamber area of the boiler is, of course, the hottest and consequently the water flows from an area of relatively cool temperature, adjacent the manifold 112, to an increasingly hot area adjacent the outlet 108. As a result, the spirally flowing water is quickly flash-heated to steam by the time it arrives at the steam-outlet manifold 108. By providing a plurality of tubes 117, the heat transfer surface area is vastly increased thereby further improving the efficiency of operation of the boiler.

The construction and operation of the condenser 53 is generally similar to that of the boiler and therefore its interior construction is not shown in detail. The condenser (FIG. 6) includes a housing 121 having a fresh air intake opening 122 formed therein adjacent its outer side wall. The air flows into the intake 122 and follows a spiral path as it moves inwardly to the center of the housing 121 and then enters the air intake opening 41 of the engine housing 11. The housing 121 includes a spiral wall similar to the wall 110 of the boiler 47 which causes the spiral movement of the flowing air. The steam exhausted from the cylinders flows out of the exhaust ports 28 and through exhaust tubes 123 to a steam intake manifold 124 at approximately the center of the housing 121. From the manifold 124 the steam flows through a plurality of heat-exchanger spiral tubes similar to the tubes 117. The tubes are, of course, also in contact with the air flowing from the intake 122 to the outlet 41, and the steam is cooled by heat-exchanger action as it flows through the condenser from the manifold 124 to the outlet manifold 126. The manifold 126 is connected by a tube 127 to the intake of the pump 52 (FIG. 1). It should be apparent that the condenser 53 is also efficient in operation because the steam entering the condenser at the manifold 124 flows in the direction of an increasingly cooler air temperature area, thereby improving or increasing the efficiency of operation of the condenser.

It is believed that the operation of the system including the engine will be apparent from the drawings and the foreoging description. Steam for operating the system is generated in the boiler 47 by combustion of fuel in the center combustion chamber of the boiler, and the steam is carried to the intake pots 24 of the two cylinders. Assuming that the power output shaft 31 and the roller assembly attached to it are turning, and this may be accomplished by initially powering the shaft 31 using a starting motor, as the pistons 22 and 23 approach bottom dead center, the steam valves 26 are opened by energizing the two solenoids 86. The steam valves may be open, for example, from approximately 10°-15° before BDC until approximately 5°-10° after BDC. The expansion chambers between the cylinder heads and the pistons are then charged with steam under high pressure which forces the roller assembly to turn as the two pistons are forced to the top dead center positions (FIG. 3) by the force of the expanding steam. At a certain point in the outward movement of each piston, the steam exhaust ports 28 are opened and the pressure within the expansion chambers is released. The roller assembly continues to turn and moves the two pistons in the opposite direction toward the bottom dead center positions again, and as soon as the exhaust outlets are closed by inward, or radially outward, movements of the pistons, the steam remaining in the expansion chambers is compressed and then the steam valves 26 are again opened to continue the cycle. It should be apparent that there are two expansion strokes in each complete revolution of the power output shaft 21. In addition, since the forces exerted by the pistons on the roller assembly and the power output shaft are simultaneous and in opposite directions, the forces on the shaft and roller assembly are balanced. The steam exhausted from the ports 28 is returned to the condenser where its temperature is reduced and then the vapor is liquified as it is compressed by the pump 52. The air is moved through the system from the condenser to the boiler by the movements of the two pistons 22 and 23, as previously explained. Thus the efficiency of the overall system is improved because the reciprocating pistons not only serve to drive the power output shaft 31 but they also move the air through the system, and the air operates to cool the steam in the condenser 53 and it is thereby preheated before being mixed with the fuel in the boiler 47.

With reference to FIGS. 5 and 7, the curvature of the crown or dome 71 of each piston and the mating curvature of the adjalcent roller serves to increase the bearing area between the two parts, thereby reducing the stresses on the parts. In addition, the two pistons are free to rotate on their axes during operation of this system so that the pistons, by rotating, present changing bearing surfaces to the rollers 36, which, of course, also reduces wear on the pistons.

In the construction shown in FIGS. 1-5, a back pressure may be maintained in the exhaust steam lines connected to the exhaust ports 28 in order to hold the pistons against the roller 36 and thereby to prevent the pistons from slapping against the rollers For example, in a system wherein the steam intake pressure is approximately 1,000 p.s.i., the back pressure may be approximately 15 to 20 p.s.i. or higher, and this may be accomplished by forming a restriction in the steam exhaust line if the back pressure does not naturally appear from the sizing of the tubes. The back pressure also enhances the condenser operation.

It should also be apparent that the engine shown in FIG. 5 may readily be disassembled for servicing or maintenance when necessary, simply by removing the snap rings 77 and 66, which enables the moving parts to be completely removed from the engine housing 11.

Figures 11, 12:
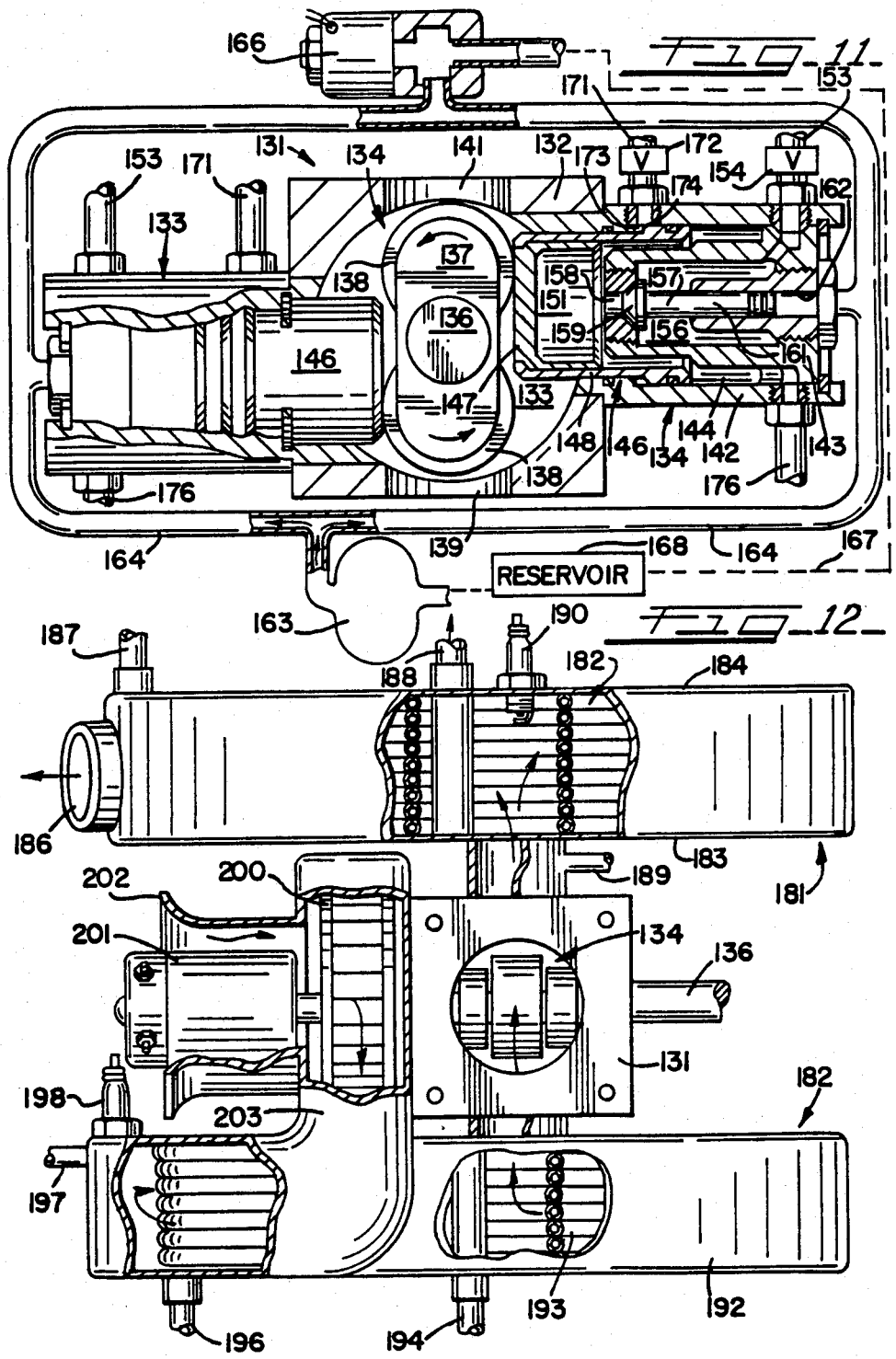
FIG. 11 is a view partly in section showing an alternate form of the invention.
FIG. 12 is another view partly in section of the form of engine shown in FIG. 11.

FIGS. 11 and 12 show another embodiment of the invention including an engine housing 131 including a central portion 132 and two cylinder portions 133 and 134. As previously mentioned, the cylinders of the invention are preferably formed in pairs as shown in FIGS. 11 and 12 and one or more pairs of cylinders may be provided. The central portion 132 is generally similar to the central portion of the engine shown in FIGS. 1-5 and includes a central opening 133 that contains a roller assembly 134. The roller assembly 134 is mounted on a power output shaft 136 and includes parallel links 137 and rollers 138 on opposite sides of the shaft 136, similar to the arrangement shown in FIGS. 1-5. The power output shaft 136 is mounted on bearings for rotation about the axis of the output shaft 136, and the axis of the shaft is substantially perpendicular of the axes of the cylinder portions 133 and 134. The housing portion 132 also includes an air inlet opening 139 and an air outlet opening 141 for the passage of air from the condenser to the boiler. Check valves (not shown) are provided in the openings 139 and 141, similar to the valvaes 43 and 44, for allowing air to flow only in the direction from the condenser to the boiler. As previously described, during operation of the engine the reciprocating motions of the pistons cause the air to be pumped through the housing portion 132.

Each of the cylinder portions includes a generally tubular outer cylinder part 142 and a cylinder head 143. The part 142 and the head 143 form an annular passage 144 between them, and a piston 146 is mounted for reciprocating motion in the passage 144. The piston 146 includes a piston head or crown 147 and a cylindrical skirt 148, and a skirt 148 extends into the annular passage 144.

As will be noted from FIG. 11, the axes of the pistons and the cylinders are offset from each other on opposite sides of the axis of the shaft 136. The shaft 136 and the roller assembly rotate in the counterclockwise direction, as seen in FIG. 11, and the offset of the piston axes from the shaft 136 axis is advantageous in that it provides greater bearing surface and therefore more effective contact between the parts during the expansion or power strokes of the pistons.

The cylinder head 143 and the interior of the piston 147 form an expansion chamber 151 between them, similar to the chamber 27 shown in FIGS. 1–5. When heated vapor or steam under pressure is admitted to the expansion chamber 151 of each cylinder, the piston of each cylinder is forced toward the top dead center position, which, as defined herein, is the point where the piston is nearest to the shaft 136.

The heated vapor, which is preferably steam, is received from a boiler by way of a steam line 153 and a control valve 154. When the valve 154 is opened, steam flows through the line 153 and into a steam chamber 156 formed within the cylinder head 143. A steam valve 157 mounted on the cylinder head 143 controls the flow of steam from the steam chamber 156 to the expansion chamber 151. A valve opening 158 is formed at the center of the cylinder head 143 and the head 159 of the valve 157 is operable to open or close the opening 158. The stem 161 of the valve 157 is movable in a guide passage 162 formed in the head 143, and the outer end of the stem 161 is subjected to the pressure of a hydraulic liquid in the passage 162. A hydraulic pump 163 is connected by pressure lines 164 to the passage 162 of each cylinder. The hydraulic pressure in the passages 162 is controlled by a solenoid operated control valve 166 which is also connected to the passages 162 and the lines 164. The control valve 166 is also connected by a return line 167 to a hydraulic reservoir 168 which returns the hydraulic liquid from the valve 166 to the intake of the pump 163. Assuming that the pump 163 is operating substantially continuously and produces a relatively high pressure on the hydraulic liquid in the lines 164 and the passages 162 when the valve 166 is essentially closed, the pressure will be substantially reduced when the valve 166 opens and enables the hydraulic liquid in the lines 164 to be bypassed to the line 167 and to the reservoir 168. When the high pressure of the pump 163 is present in the passages 162, the valves 157 are moved to close the openings 158 and thereby prevent the flow of steam from the steam chamber 156 to the expansion chambers 151. The steam pressure, in a specific example of the invention, may be approximately 2,000 p.s.i. and the hydraulic liquid pressure in the passages 162 when the valve 166 is closed may be approximately 3,000 p.s.i. As a consequence, the hydraulic liquid pressure in the passages 162 is sufficient to force the steam valves 157 to the closed position. When the hydraulic valve 166 is opened, the pressure in the passages 162 is released and the pressure in the chamber 151 is sufficient to open the valve 157. Of course, once the valve 157 is opened slightly, the stream pressure in the steam chamber 156 is able to force the steam valves entirely open and the steam then flows into the expansion chambers 151. The hydraulic valve 166 is connected to a mechanism such as that shown in FIG. 10 for cyclically opening and closing the valve 166 in synchronism with the rotation of the power output shaft 136.

In the embodiment of the invention shown in FIGS. 11 and 12, means is also provided for moving the pistons 146 to their retracted or bottom dead center positions. This means comprises a high pressure vapor or steam line 171 which is connected through a valve 172 to a retraction chamber 173 formed between the skirt 148 of the piston and the outer cylinder part 142. The piston skirt 148 is recessed in the area indicated by the numeral 174 to form the retraction chamber 173. When high pressure steam enters the retraction chamber 173, it exerts pressure against the shoulder forming the reduced diameter part of the skirt and forces the piston outwardly or to their bottom dead center positions. The retraction valves 172 are operated in synchronism with the control vales 154 so that the steam pressure in the chambers 156 is present only when the valves 172 are closed and pressure in the retraction chambers 173 is absent. The converse is, of course, also true.

The arrangement of the retraction chamber is particularly advantageous when the engine is being started so that the pistons may be held at the bottom dead center positions and out of engagement with the roller assembly during the starting of the engine. Such operation enables a freewheeling action of the roller assembly which makes it easier to start the engine. The retraction valve may also be utilized when the engine is to be coasted during a period of normal operation, to prevent the roller assembly from slapping against the piston crowns.

The cylinders also include steam return passages which lead to a return line 176 for exhausting the steam from the cylinders as previously described. The exhaust lines 176, of course, lead to the condenser of the engine.

FIG. 12 shows the arrangement of the boiler 181 and the condenser 182 in more detail. The boiler 181 is similar to the boiler 47 except that the internal spiral wall 110 has been deleted. As shown in FIG. 12, the boiler 181 includes a plurality of tubes, which could, of course, be a single flattened tube 182, which extends essentially the full distance between the side plates 183 and 184 of the boiler. The tubes 182, being closely spaced, form a wall across the width of the boiler housing, and the tubes spiral in the manner of the tubes 117 shown in FIGS. 8 and 9. Thus the tubes 182 form both a passage means for the steam-liquid and a wall for routing the exhaust gases of the burner from the central combustion chamber to an exhaust outlet port 186. The boiler 181 also includes a liquid intake line 187, a steam or heated vapor line 188, a fuel inlet line 189 and an igniter 190. In other respects, the boiler 181 is similar to the boiler 47.

With regard to the condenser 182, it is constructed quite similarly to the boiler 181 and includes a housing 192 and tubes 193 which carry the water-vapor and also form a spiral wall for the air flowing through the condenser 182. The exhaust steam from the engine enters the condenser 182 through an inlet 194 and leaves the condenser through a condensate outlet 196.

The condenser 182 preferably also includes a burner for preheating the air which enters the condenser 182 when the engine is being started in cold weather. The heater or burner includes a fuel intake line 197 and an igniter 198 which are located adjacent the outer periphery of the housing 192 adjacent the air intake. The air may thus be preheated during cold weather to prevent cold air from freezing the liquid in the tubes 193 before the boiler 181 is able to raise the temperature of the liquid. Once the engine has warmed to normal operating temperatures, the condenser burner may be turned off.

Also connected to the power output shaft 136 of the engine are an air intake blower 200 and a starter-generator 201. The blower 200 includes a cowling 202 through which the intake air flows to the blower 200, and a duct 203 which leads the intake air from the blower 200 to the air intake of the condenser 182. The starter-generator is used to rotate the power output shaft 136 in order to pump intake air through the housing 131 as the engine is being started, and the starter-generator 201 may also be used to generate electricity and recharge an engine battery during normal engine operation.

The engine may utilize a variety of other fuels such as gas or a solution including ground up coal.

A system may include a plurality of engines of the character described herein, connected to the same power output shaft 31. By angularly displacing the cylinders of the engine, a more continuous output torque would be obtained.

Figure 13:
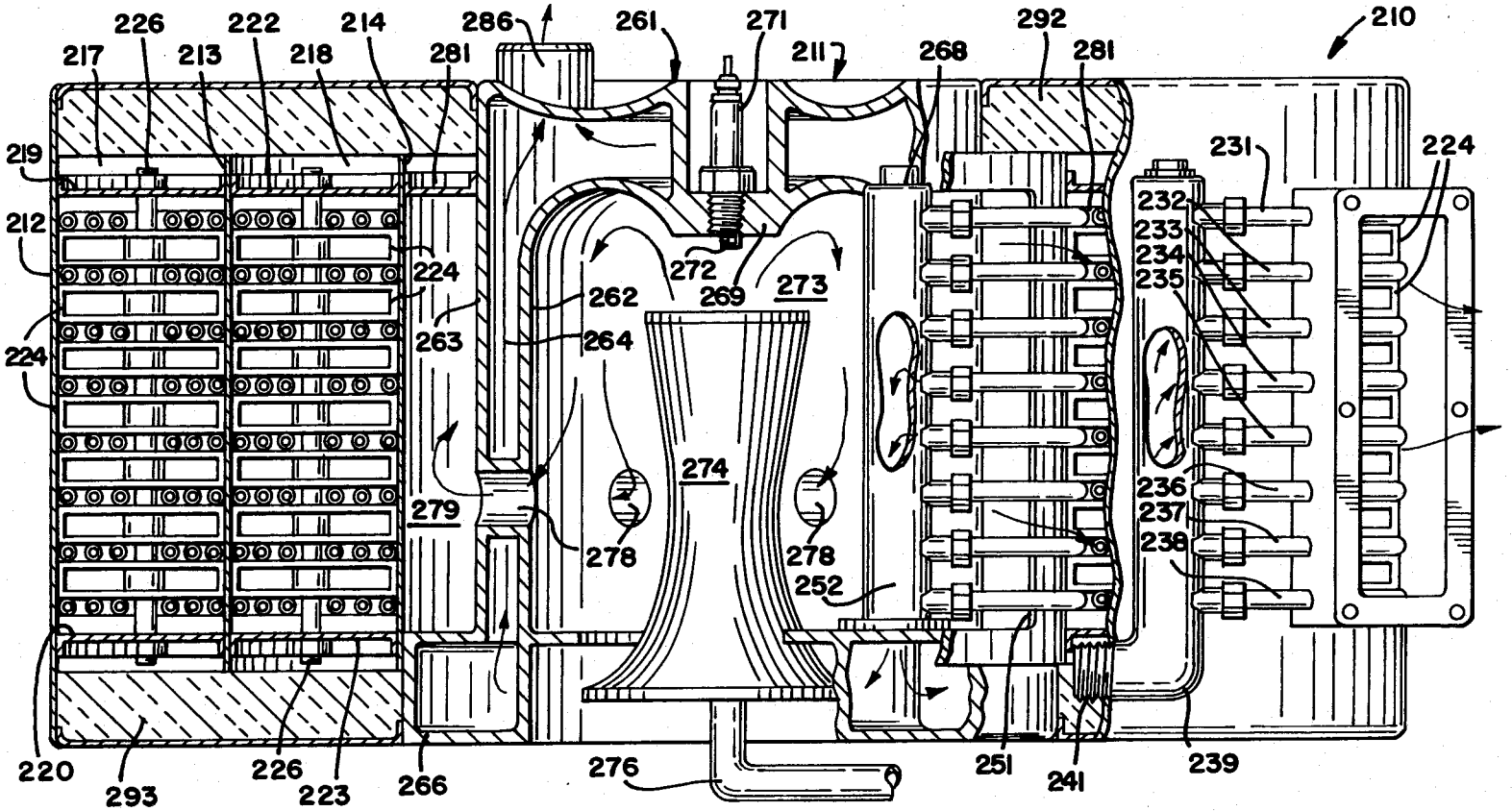
FIG. 13 is a sectional view of a heat exchanger in accordance with a preferred embodiment of the invention.
Figure 14:
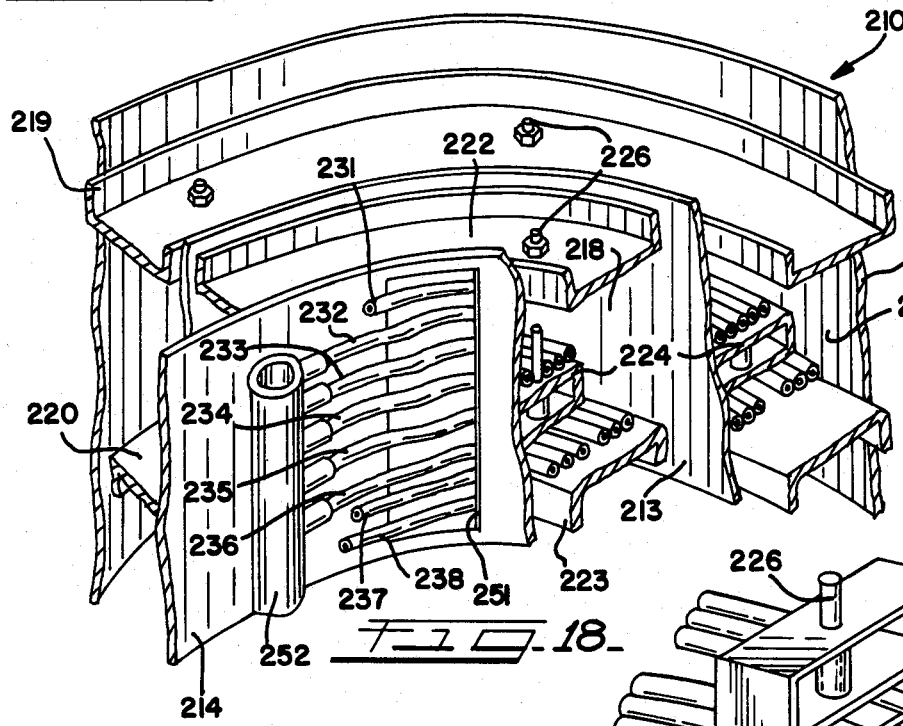
FIG. 14 is a fragmentary perspective view of part of the exchanger of FIG. 13.
Figure 18:
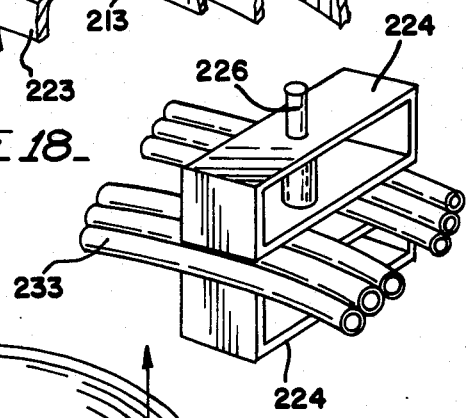
FIG. 18 is a fragmentary perspective view of part of the exchanger.

FIGS. 13 through 16 illustrate a preferred form of the heat exhanger. In this example, the heat exchanger comprises a vapor generator for providing a supply of steam to the engine. The vapor or steam generator illustrated in FIGS. 13 through through 16 includes a heat exhanger part 210 and a burner assembly 211. With reference first to the heat exchanger part 210, it is formed by a cylindrical outer wall 212, a cylindrical intermediate wall 213 and a cylindrical inner wall 214, the three walls 212, 213 and 214 being mounted coaxially one within the other. The two walls 212 and 213 form between them an exterior chamber 217 and the two walls 213 and 214 form between them an interior chamber 218. The upper and lower ends of the exterior chamber 217 are closed by top and bottom plates 219 and 220, and similarly the upper and lower ends of the interior chamber 218 are closed by top and bottom plates 222 and 223. As shown in FIG. 14, for example, the plates 219, 220, 222 and 223 are annularly shaped. Stacked up between the upper and lower plates in each of the interior and exterior chambers 218 and 217 are a plurality of coil separators 224. Each of the coil separators 224 (see FIG. 18) has a short annular dimension and a plurality of separators are provided around the circumference of each chamber. Further, each separator has a hollow rectangular configuration when viewed in cross section as shown in FIGS. 13 and 18. A plurality of tie bolts 226 are provided to secure the top and bottom plates and the separators in each of the chambers together, a set of tie bolts 226 being provided in the exterior chamber and another set of tie bolts being provided in the interior chamber. The tie bolts 226 and 227 extend axially of the assembly and nuts at their ends are provided to hold the top and bottom plates and the separators in assembled relation. The radially inner and outer surfaces of the top and bottom plates and the separators fit snugly against the walls 212–214.

The heat exchanger further comprises a set of fluid tubes which spiral between the outside of the outer wall 212 and the interior of the inner wall 214. In the present example, a set of eight tubes 231–238 are provided, each of the eight tubes having its outer end connected to a fluid manifold 239. The manifold 239 has a coupling end 241 which is adapted to be connected to other fluid conduits (not shown in FIGS. 13 through 16) which are part of the overall system including the engine. As best shown in FIG. 13, the tubes 231–238 are vertically spaced by a distance which is substantially equal to the vertical height of the coil separators 224, and the tubes extend from the manifold 239 circumferentially and radially inwardly as shown in FIG. 16 through a vertically elongated opening 242 formed in the outer wall 212. In the instance where eight tubes 231–238 are provided as illustrated, a total of seven sets of spaced coil separators 224 are provided, the interior six of the tubes extending between adjacent separators 224 and the tubes 231 and 238 being located on the outer surfaces of the endmost separators 224. The tube 232, for example, extends radially inwardly through the opening 242 into the exterior chamber 217 and extends between the two uppermost sets of coil separators 224. The tube 232 spirals circumferentially and radially inwardly within the exterior chamber 217 and it forms a coil 243, best shown in FIG. 16. Each of the tubes 231–238 forms a similar coil, and in the present example the diameter of the tubes relative to the radial width of the exterior chamber 217 is such that six turns of the tube are provided within the exterior chamber 217. With specific reference to FIG. 16, an opening or passage 250 is formed through the intermediate wall 213, and the tubes 231–238 are bent as shown in FIG. 16 and pass from the exterior chamber 217 into the interior chamber 218. Similarly to the arrangement of the coiled tubes in the exterior chamber 217, the tubes are again coiled in the interior chamber 218 as best shown in FIGS. 14 and 16. Again, six turns of the tubes are provided in the interior chamber 218.

The inner wall 214 also has an opening or passage 251 (FIGS. 14 and 16) formed in it which is generally similar to the opening 250 formed in the intermediate wall 213. The tubes 231 and 238 are bent to extend through the opening 251 and the inner ends of the tubes are connected to a vertically extending fluid outlet manifold 252. Thus the tubes 231–238 are located in vertically spaced relation and extend circumferentially of the three walls 212, 213 and 214, the tubes first extending through an opening 242 formed in the outer wall 212, spiraling to form the coils in the exterior chamber 217, then passing through an opening 250 in the intermediate wall 213, coiling to form the turns in the interior chamber 218, extending through the opening 251 in the inner wall 214, and then connecting to the manifold 252. Consequently a fluid, such as water, pumped into the manifold 239 will follow parallel paths through the eight tubes 231–238 and will spiral first through the exterior chamber, then through the interior chamber and will then mix and be collected in the fluid outlet manifold 252.

As previously mentioned, the form of the heat exchanger illustrated in FIGS. 13 through 16 is a boiler or steam generator, and to this end a burner is mounted within the interior of the inner wall 214. The burner assembly 211 (see specifically FIGS. 13, 15, and 16) comprises a double-walled burner housing 261 which is generally circular in a horizontal cross section. The housing 261 is formed by inner and outer walls 262 and 263 which are radially spaced to form a flow passage 264 between them. At their lower ends, the inner and outer walls 262 and 263 extend radially upwardly to form a ledge 266, and an opening 267 is formed in the upper surface of the ledge 266. The lower end of the manifold 252 is mounted on the ledge 266 with the opening of the manifold in communication with the opening 267, so that fluid flowing into the manifold 252 flows downwardly, through the opening 267, and into the flow passage 264 between the inner and outer walls. The upper end 268 (FIG. 13) of the manifold 252 is closed.

The upper ends of the two walls 262 and 263 extend radially inwardly and are joined by an upper wall 269 which supports a spark plug 271. The points 272 of the plug 271 are located below the wall 269 and within the interior of the combustion chamber 273 formed within the inner wall 262. A generally tubular mixing tube 274 extends concentrically upwardly into the interior of the combustion chamber 273 and is supported by a fuel nozzle (not shown) connected to the end of a fuel line 276. Thus during operation of the burner, fuel flowing out of the line 276 and sprayed into the interior of the tube 274 mixes with combustion air which is drawn upwardly from the lower end of the tube 274. The combustible mixture flows upwardly out of the upper end of the tube 274 and is ignited by the spark plug 271. The flame and hot combustion gases move upwardly and curve radially outwardly and then downwardly as indicated by the arrows in FIG. 13. A plurality of radially extending gas flow passages 278 are formed through the housing 261, the outer sides of the passages 278 being in communication with a tempering chamber 279 formed between the outside of the housing 261 and the inner wall 214. The lower end of the tempering chamber 279 is closed by the step 266 of the housing 261 and the upper end of the tempering chamber 279 is closed by an annular plate 281. Thus, the hot combustion gases and heat from the combustion chamber 273 flow through the openings 278 and into the tempering chamber 279, and they then flow through the passage 251 formed in the inner wall 214. The hot gases flow through annular flow spaces 281 (FIG. 13) formed around the coils of the tubes 231–238 and through the coil separators 224 in the interior chamber 218. The hot gases then flow through the opening 250 formed in the intermediate wall 213 and into the exterior chamber 217. In the exterior chamber, the gases flow through flow spaces around the turns of the tubes 231–238 and through the coil separators 224. Finally, the hot gases flow through the opening 242 formed in the outer wall 212. A draft inducer or blower 283 has its intake connected around the opening 242 and is driven by an electric motor 284. Thus, the blower 283 draws the combustion gases through the flow spaces in the interior and exterior chambers and out from the combustion chamber 273. Bulkheads 282 (FIG. 16) are mounted in the chambers 217 and 218 adjacent the openings 242, 250 and 251 to direct the flow of the gases opposite to the direction of coiling of the tubes 231–238.

It was previously mentioned that the fluid flowing through the tubes 231–238 flows into the outlet manifold 252 and then into the interior flow space 264 of the housing 261. An outlet connection 286 (FIGS. 13 and 15) is provided on the top wall of the burner housing 261 and is adapted to be connected to a conventional fluid coupling for carrying the fluid away from the heat exhanger. At the other ends of the tubes 231–238, a fluid pump 286 (FIG. 16) has its outlet 287 connected to the intake of the manifold 239, the inlet 288 of the pump 286 also being adapted to be coupled to a fluid fitting (not shown).

In the operation of the boiler shown in FIGS. 13–16, the burner assembly 211 generates heat and hot gases within the combustion chamber which flow through the tempering chamber 278, through the inner and outer chambers 217 and 218 and around the tubes 231–238, and out of the heat exhanger through the blower 283. Simultaneously, the fluid, in this instance water, is fed into the manifold 239 from the pump 286 and is circulated through the tubes 231–238. The water flows radially inwardly first through the coils in the outer chamber 217 and then through the coils in the inner chamber 218. The water in the coils flows radially inwardly into the manifold 252 and then flows into the passage 264 formed in the housing 261 of the burner assembly. Finally, the water flows out of the chamber 264 and through the outlet 286.

Thus, while the heat and hot combustion gases flow radially outwardly from the combustion chamber to the blower 283, the water flows radially inwardly from the pump 286 to the outlet 291. The heat of the combustion gases is given up to the tubes 231–238 and to the water flowing through them, and the gases are gradually cooled as they flow outwardly whereas the water is gradually heated as it flows inwardly. The water is very hot as it reaches the manifold 252 and then is given a final heating and vaporized while flowing through the passage 264 in the housing 261. To reduce heat loss from the exchanger, annular layers 292 and 293 (FIG. 13) are preferably provided at the ends of the chambers 217 and 218, and additional installation may be provided around the outside of the heat exchanger if desired.

A control 294 (FIG. 16) is connected in the fuel line 276 to the burner and controls the fuel flow rate in accordance with factors such as the flow rate of the water and the inlet and outlet temperatures of the water.

In the event the heat exchanger is to be used as a condenser, for example, instead of a boiler, the burner assembly 211 may be eliminated. In this event the water, or other fluid to be condensed, is piped from the pump 286 to the inlet manifold 239, through the tubes and from the outlet manifold 252 to a collector for the condensate. The blower 283 draws air into the interior of the inner wall 214 (in the area of the tempering chamber 279), through the openings 251 and 250 and out of the chambers. In this event, the air flowing through the interior and exterior chambers cools the water flowing through the tubes 231–238 and, of course, at the same time the air is being heated and this preheated air may be fed to the boiler as previously described in connection with FIGS. 1–4.

Figure 15:
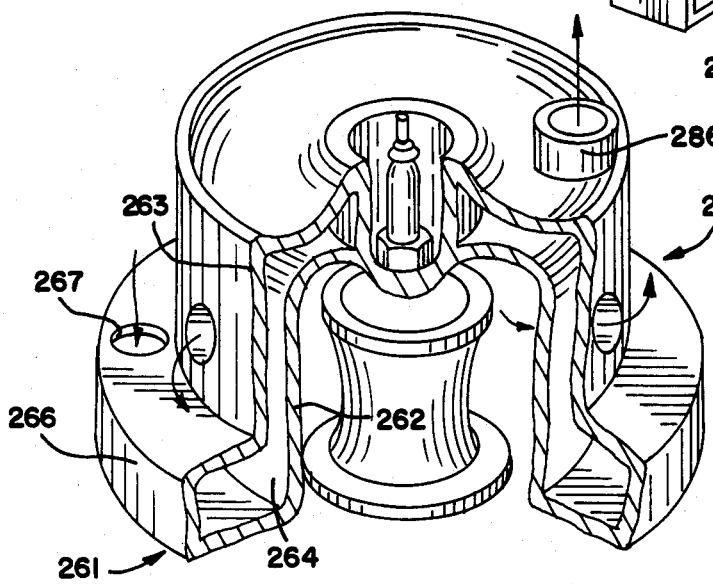
FIG. 15 is a perspective view of a burner of the exchanger.
Figure 17:
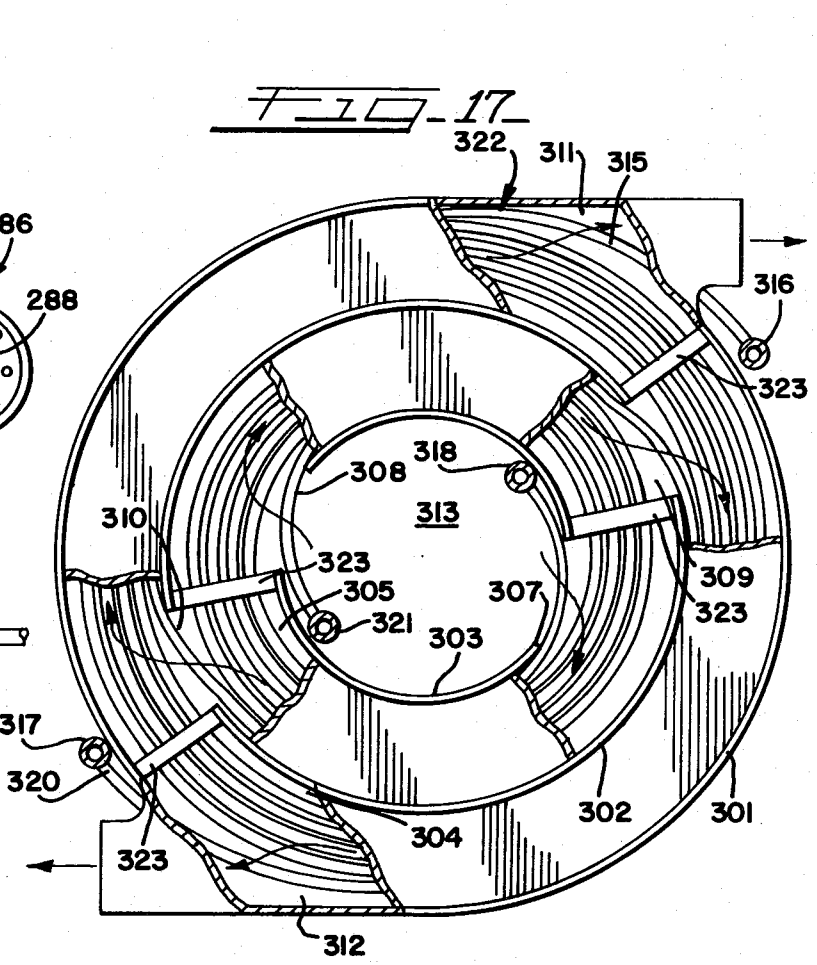
FIG. 17 is a plan view of another form of heat exchanger in accordance with the invention.
Figure 16:
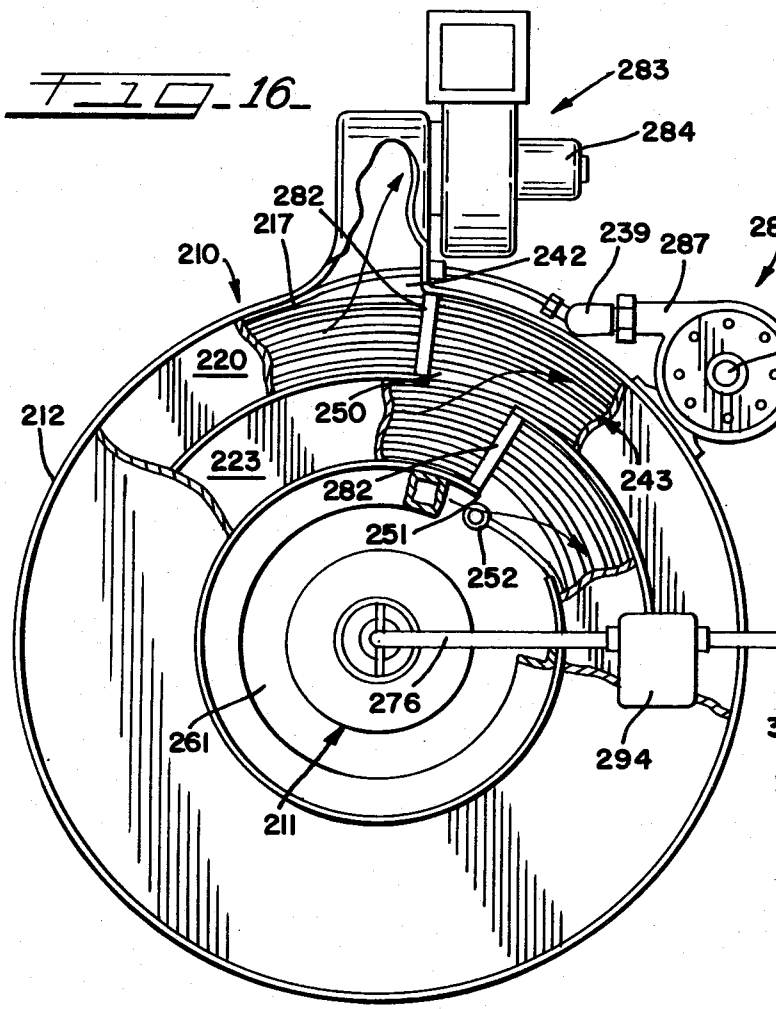
FIG. 16 is a top plan view of the exchanger with parts broken away.

FIGS. 17 illustrates a heat exchanger which is generally similar to that shown in FIGS. 14 through 16 with the exception that a double spiral of tubes is provided rather than a single spiral. The exchanger shown in FIG. 17 includes outer, intermediate and inner walls 301, 302 and 303 forming an annular outer chamber 304 and an annular inner chamber 305 which is concentric with the outer chamber 304. A pair of openings 307 and 308 are formed in the inner wall 303, a pair of openings 309 and 310 are formed in the intermediate wall 302, and a pair of openings 311 and 312 are formed in the outer wall 301. Thus air, or hot gases in the case of a boiler, are able to flow along a path between the interior 313 of the heat exchanger, through the passages 307 and 308, the interior chamber 305, the passages 309 and 310, the exterior chamber 304, and the passages 311 and 312.

On the outside of the outer wall 301 are provided two water manifolds 316 and 317, each of which corresponds to the manifold 239 shown in FIG. 13. A plurality of vertically spaced tubes 315 (only one shown in FIG. 17) corresponding to the tubes 231–238 are connected to the manifold 316, and the tubes 315 spiral radially inwardly through the opening 311, the outer chamber 304, through the opening 310 and inner chamber 305, through the opening 307 and the innermost chamber 313 to an outlet manifold 318. Similarly, another plurality of tubes 320, similar to the tubes 315, spiral radially inwardly from the manifold 317 and through the opening 312, the exterior chamber 304, the passage 309 and the interior chamber 305, the passage 308 and into the innermost chamber 313 to a second outlet manifold 321. Each of the tubes 315 coils radially inwardly and forms a plurality of turns which are interleaved with the turns of the other tubes 320 which are on the same level as the tubes 315. Thus the tubes 315 and 320 in each layer combine to form a coil 322, and since a plurality of vertically spaced tubes 315 and a plurality of similarly spaced tubes 320 are provided, a plurality of stacked coils 322 are also provided in each chamber, similar to the coils shown in the embodiment of the invention in FIG. 13.

Once again, bulkheads 323 are provided across the exterior chamber 304 and across the interior chamber 305 adjacent the openings formed in the walls 302 and 303, in order to direct the flow of air through the openings 308 and 309.

In the event the heat exchanger shown in FIG. 17 is to be used as a boiler, a burner assembly similar to that shown in FIG. 15 is mounted within the innermost chamber 213, and the two outlet manifolds 318 and 321 are connected to the step 266 and both manifolds feed the liquid into the flow passage 264 of the housing 261. Aside from the fact that a double spiral of tubes is provided in each of the chambers, the construction shown in FIG. 17 is generally the same as that shown in FIGS. 14–16. In both forms of the invention, the parts are preferably made of stainless steel.

What is claimed is:

1. A heat exchanger comprising wall means including concentric cylindrical first and second walls forming at least one annular chamber, a plurality of tubes positioned in said chamber, said walls having a central axis and each of said tubes spiraling about said axis, said tubes being spaced apart in the direction of said axis and each of said tubes forming a generally flat coil in said chamber, each of said tubes having outer and inner ends adapted to be connected to means for flowing a first fluid through said tubes, and said wall means having inlet and outlet openings formed therein enabling a second fluid to be flowed through said annular chamber and around said tubes.

2. A heat exchanger as in claim 1, wherein said inlet and outlet openings are formed in said first and second walls, and said inner and outer ends of said tubes extend through said inlet and outlet openings.

3. A heat exchanger as in claim 2, and further including first and second manifolds respectively connected to said inner and outer ends of said tubes.

4. A heat exchanger as in claim 1, and further including a burner assembly mounted within the innermost of said first and second walls, said second fluid including the hot exhaust gases of said burner assembly, and said inlet opening being adjacent said burner assembly and receiving said gases.

5. A heat exchanger as in claim 1, and further comprising a second plurality of tubes positioned in said chamber, each tube of said second plurality spiraling closely adjacent one of said first mentioned plurality of tubes.

6. A heat exchanger as in claim 5, wherein said wall means further has additional inlet and outlet openings therein, and said second plurality of tubes extending through said additional inlet and outlet openings.

7. A heat exchanger as in claim 1, wherein said wall means first includes a third wall concentric with said first and second walls, said first, second and third walls forming said one annular chamber and a second annular chamber which is concentric with said one annular chamber, and said plurality of tubes further spiraling through said second annular chamber.

8. A heat exchanger as in claim 1, and further comprising a plurality of separators between adjacent coils.

9. A heat exchanger comprising wall means including concentric cylindrical outer, intermediate and inner walls forming an annular exterior chamber and an annular interior chamber, each of said outer, intermediate and inner walls having at least one opening formed therein, a plurality of tubes extending through said openings, each of said tubes spiraling and forming a coil in said exterior chamber and forming another coil in said interior chamber, said coils being spaced apart in the direction of the axis of said spiral.

10. A heat exchanger as in claim 9, and further including a burner assembly mounted within said inner wall and adjacent said opening in said inner wall, whereby exhaust gases from said burner assembly flow through said openings and through said interior chamber and then through said exterior chamber.

* * * * *